US006021734A

United States Patent [19]

Sperberg

[11] Patent Number: 6,021,734

[45] **Date of Patent: *Feb. 8, 2000**

[54] PERSONAL WATERCRAFT AND BRACE ASSEMBLY THEREFOR

[75] Inventor: Ronald Henry Sperberg, Shawano, Wis.

[73] Assignee: Spotter, LLC, Shawano, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,195

[22] Filed: May 6, 1997

[51] Int. Cl.[7] ..... B63B 17/00

[52] U.S. Cl. ..... 114/363; 114/55.57

[58] Field of Search ..... 114/270, 362, 114/363; 297/215.1, 195.1, 353, 215.11, 215.12, 195.11

[56] References Cited

U.S. PATENT DOCUMENTS

| | | | |
|---|---|---|---|
| D. 328,054 | 7/1992 | Thorpe | D12/307 |
| 1,139,184 | 5/1915 | Johnson | 297/215.12 |
| 4,475,770 | 10/1984 | Persons, II | 297/353 |
| 5,041,040 | 8/1991 | Jones et al. | 297/195 |
| 5,218,922 | 6/1993 | Kobayashi | 114/363 |
| 5,320,059 | 6/1994 | Ikeda | 114/363 |
| 5,501,168 | 3/1996 | Zachary | 114/363 |
| 5,570,654 | 11/1996 | Rood | 114/363 |
| 5,586,922 | 12/1996 | Kobayashi et al. | 440/88 |
| 5,695,249 | 12/1997 | Lotfi | 297/353 |

*Primary Examiner*—Ed Swinehart

*Attorney, Agent, or Firm*—Thomas D. Wilhelm; A. Nicholas Trausch III

[57] ABSTRACT

This invention pertains to personal watercraft and to brace assemblies for use on personal watercraft. The brace assembly enables a rear-facing rider to be stabilized so that the rider is not uncomfortable and does not readily fall from the watercraft. Such rear-facing rider spots for a water skier being pulled by the personal watercraft. The brace assembly includes an engagement structure, a support column supporting the engagement structure, and a support housing supporting and containing the support column. The support column raises the engagement structure to a first raised position and retracts into the support housing at a second lowered position. Height adjustment apparatus controls moving the engagement structure between the raised and lowered positions. Mounting apparatus, including a mounting bracket, mounts the brace assembly to the personal watercraft. Fasteners preferably mount the brace assembly to a boarding handle of the personal watercraft. In some embodiments, the brace assembly is disposed in a space defined between the boarding handle and the seat. In other embodiments, the support housing is mounted to the outside edge of the boarding handle. In preferred embodiments, the brace assembly is mounted to the personal watercraft without making any holes in the personal watercraft.

65 Claims, 7 Drawing Sheets

PERSONAL WATERCRAFT AND BRACE ASSEMBLY THEREFOR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND

This invention relates to personal watercraft. As used herein, "personal watercraft" means jet skis, such as those made by SEADOO®, POLARIS®, ARCTIC CAT®, KAWASAKI® and other companies. Such watercraft have a hull, including a floatation body, generally low in the water, housing a drive engine and other drive apparatus. The hull typically includes a central body portion upstanding from a gunwale which extends about the left and right sides, and the rear, of the watercraft. A longitudinally-extending seat is typically mounted on the central body portion, for supporting the driver and one or more passengers (typically no more than two passengers plus the driver) such that the driver and passengers straddle the seat when riding on the watercraft. The seat is thus between the two legs of each rider, including the driver. The gunwale is close to the water line. The rider's feet are also close to the water line, near the gunwale. Other than the gunwale, there is generally little or no watercraft structure between the rider's feet and the outer edge of the personal watercraft. The personal watercraft drive and direction controls are generally incorporated into a control console located in front of the seat, for manipulation and other use by the driver.

The longitudinally-extending seat generally encourages forward-facing riders to lean forward. The front rider is the driver, who holds onto an opposing pair of hand grips extending from the watercraft control console. Riders sitting behind the driver hold onto the driver, or the rider in front of them, to maintain their position, and to stabilize them, as the personal watercraft accelerates and/or moves in accord with the power and direction control exercised by the driver. This arrangement is generally acceptable for the driver and forward-facing riders.

More recent models of personal watercraft are sized and powered by water-jet engines, to pull a water skier. Such watercraft typically have a ski tow ring mounted thereon for attaching a tow rope used to tow the water skier. According to USA Coast Guard regulations, when any watercraft is towing a water skier, the watercraft crew must include a spotter who watches the water skier and advises the watercraft driver of the disposition of the water skier. The spotter faces the water skier in order to immediately observe any changes in the skier's disposition, thus to promptly notify the driver of any such change. Thus, on personal watercraft, when towing a water skier, the passenger/spotter is a second person on the watercraft, in addition to the driver, and in addition to the skier being towed. Given the longitudinally-extending seat, the spotter is located behind the driver, and faces in a rearward direction, when the watercraft is pulling the skier.

Because of the rearward orientation, the spotter encounters a problem in that, on conventional personal watercraft, the spotter has no readily available watercraft structure to hold onto for lateral (front-to-rear, or side-to-side) support.

Thus, in the rearward orientation, the stability, and accordingly, the safety, of the spotter are in jeopardy. Namely, in view of the design of conventional personal watercraft, and considering the high degree of maneuverability of such (small) watercraft, it is difficult for a rear-facing rider to maintain a stable position during normal operation of the watercraft. Such watercraft are highly mobile and maneuverable such that all riders need something to hang onto, thus to avoid being thrown about the watercraft, or being thrown from the watercraft into the water. The driver holds onto the hand grips. The rear-facing rider has little or nothing to hold onto.

Given the longitudinally-extending seat, the tendency for any rider is to lean toward the front of his/her body. For a rear-facing rider, the tendency is thus to lean toward the rear of the watercraft. Since there is typically nothing effective for the rear-facing rider to grasp onto with his/her hands, thus to effectively stabilize himself/herself on the watercraft, the rider has a sensation, and an actual natural tendency, to lurch forward (toward the rear of the watercraft) or to the side, and thus to fall off the personal watercraft, in response to sudden maneuvers, especially accelerations and turns. This is especially true when the personal watercraft is beginning to accelerate from a stop to pull a skier.

For skiing, rapid acceleration is critical to the skier. However, such rapid acceleration which is so important to the skier is a threat to the safety of an improperly-supported spotter on the personal watercraft. For example, under rapid acceleration, the front of the watercraft tends to rise quickly, thus to lift the watercraft at a steep angle up onto a planing relationship with the water at skiing speed. Given this environment, a rider with nothing effective to hang onto can easily be thrown off the personal watercraft. Other changes in speed, and changes in direction, can also cause a rider to fall from the watercraft or to be otherwise destabilized.

One known attempt to address the problem is provision of a handle secured to the watercraft at or adjacent the rear of the watercraft seat, and wherein the operative handle is, and remains, at or below the top support surface of the seat. This arrangement requires a rider to reach downward to grasp the handle at or below the height of the top of the seat. The problem with this arrangement is that the center of gravity of the rider is a significant distance above the handle. Thus, while the handle does provide some support, the support is grossly insufficient to provide the needed support to the rider during normal maneuvering of the watercraft. Further, such handle can act as a fulcrum about which the rider can be pivoted/thrown, thus increasing the risk of the rider being thrown and falling from the watercraft during normal usage of the watercraft. This risk is especially apparent at start-up from a stop, as the front of the watercraft rises relative to the rear of the watercraft. Namely, the low location of the handle provides little or no assistance at the height of the rider's effective center of gravity.

Even if the rider does not fall from the watercraft, with the handle located below the effective center of gravity, the rider tends to lean forwardly (toward the rear of the watercraft) and requires substantial ongoing exertion of muscular energy of the arms and shoulders in utilizing such handle to obtain what small stability benefit the rider may obtain during e.g. gentle maneuvering of the watercraft. Such an arrangement is uncomfortable for the rider, thereby reducing the enjoyment of riding on the watercraft.

While it is common for a rider, including the driver, to fall from a personal watercraft, and while it is not expected that this invention will prevent all falls from personal watercraft, it is an object of this invention to provide a brace assembly for use on personal watercraft which will assist a rear-facing rider in stabilizing himself/herself to thereby reduce the number of falls from personal watercraft.

SUMMARY

This invention relates to personal watercraft, and to brace assemblies for supporting a rear-facing rider on a personal watercraft. The brace assemblies can be mounted on the vehicle by a manufacturer of the watercraft or may be mounted as an aftermarket product such as by an end user. The brace assemblies of the invention increase the safety, comfort, and enjoyment of the rear-facing rider.

In general, the invention provides a comfortable and versatile retractable body engagement structure, and supporting apparatus, for use in stabilizing a rear-facing rider on a personal watercraft, enabling the rider easily, surely, and with minimal effort, to stabilize himself/herself during normal operation, including aggressive maneuvering, of the personal watercraft. The brace assembly permits a rear-facing passenger to sit, substantially braced against falling, in a substantially upright position, greatly increasing the passenger's comfort and safety.

The engagement structure grasped by the rear-facing rider is located at a height well above the top support surface of the watercraft seat, preferably proximate the rider's effective center of gravity, where the rear-facing rider can comfortably grip the support/engagement structure with his/her hands, thereby to stabilize himself/herself with little or no discomfort, while watching the water skier or other object being towed behind the personal watercraft. Thus, the prior art problem of instability when facing rearwardly on a longitudinally-aligned seat on the personal watercraft, to spot for a water skier, or other towed object, has been solved.

Further, the invention includes the option of lowering the support below the seat, or to a lowered height no more than 2 inches above the seat for typical applications, so that a person in the water can easily climb aboard the personal watercraft and over the support, from the rear, without greatly increasing the risk of tipping the personal watercraft over.

Figure 1:
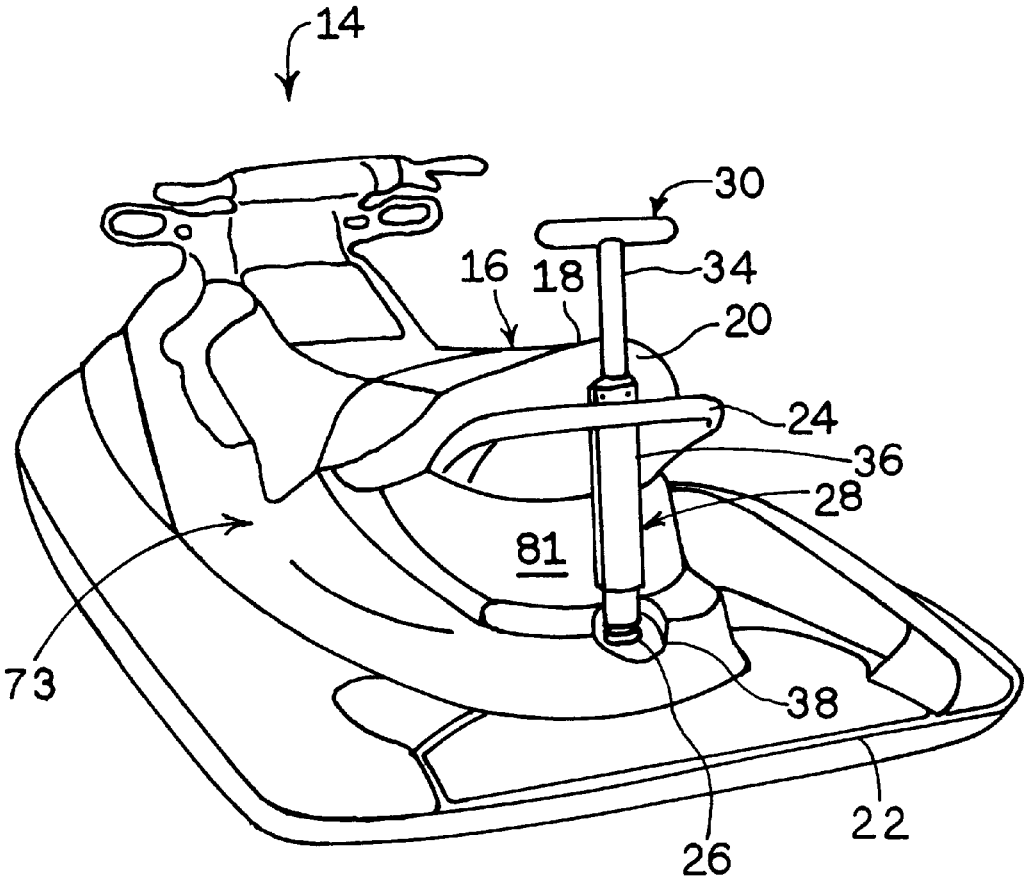
FIG. 1 shows rear pictorial view of a personal watercraft of the invention including a brace assembly of the invention.

The invention is not limited in its application to the details of construction and the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 11:
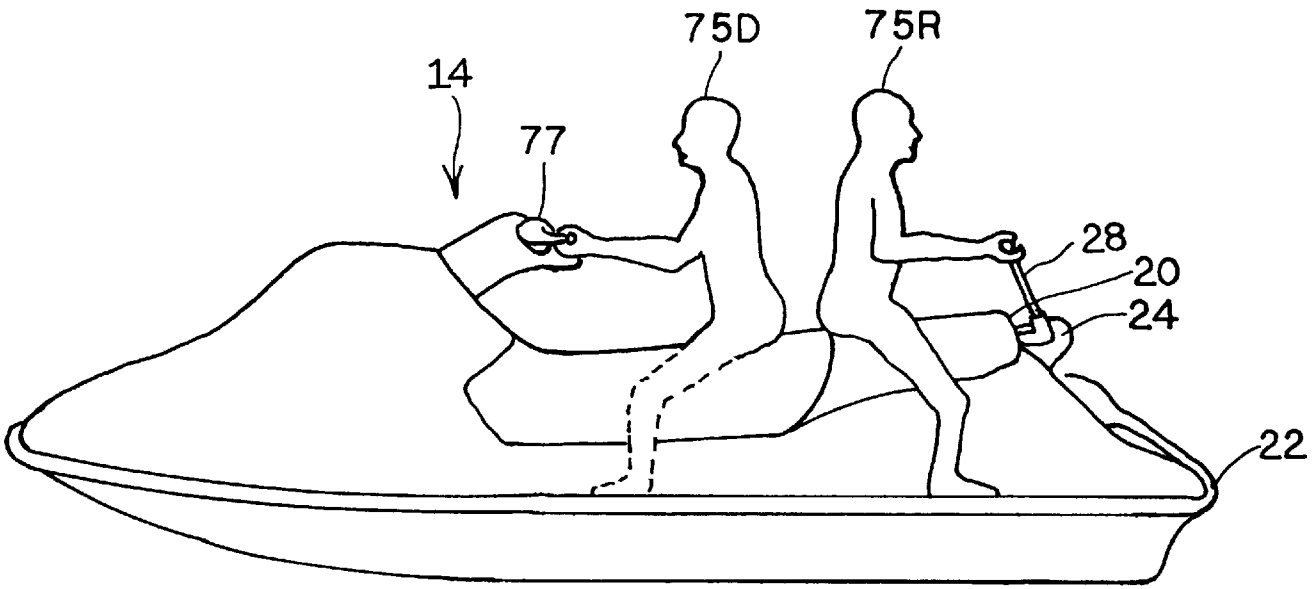
FIG. 11 shows a representative side elevation of a personal watercraft incorporating a brace assembly of the invention.

Referring now by characters of reference to the drawings, and first to FIGS. 1 and 11, a personal watercraft 14 includes a longitudinally-extending watercraft seat 16 having a top support surface 18 and a rear 20 disposed toward the rear edge 22 of the personal watercraft. Personal watercraft 14 further includes a boarding handle 24 which users may access for assistance in climbing out of the water and onto the watercraft from the rear. The personal watercraft further includes a tow eye 26 for attaching a tow rope to the watercraft, to thereby tow water skiers or other objects behind the watercraft.

Brace assembly 28 is secured to personal watercraft 14 adjacent rear edge 22. In the raised position, brace assembly 28 projects upwardly adjacent the rear 20 of seat 16, well above the top surface 18 of the seat, thereby enabling a rider straddling the longitudinally-extending seat while facing to the rear to stabilize himself/herself while watching a water skier, tube, raft, or other object being towed behind the watercraft, or while simply enjoying the ride while facing to the rear of the watercraft. "Top surface" of the seat refers to that portion of the seat on which the rear-facing rider is sitting.

Brace assembly 28 includes engagement structure 30, height adjustment apparatus 32 (shown in FIG. 2), support column 34, support housing 36, and mounting bracket 38. Brace assembly 28 generally is used with personal watercraft 14, having the longitudinally-extending central seat such as at 16.

ENGAGEMENT STRUCTURE

Figure 2:
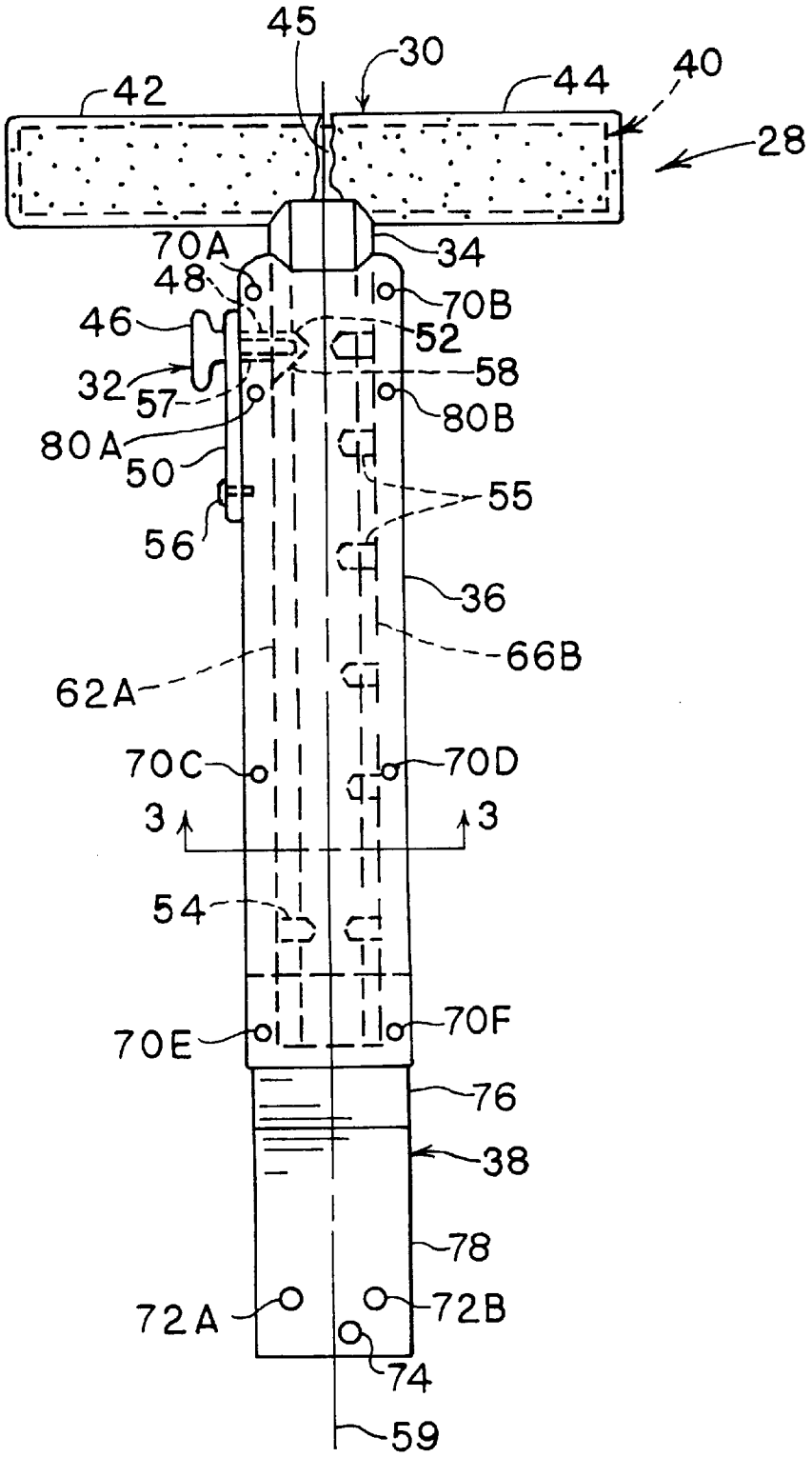
FIG. 2 shows a front elevation view of a brace assembly of the invention.
Figure 4:
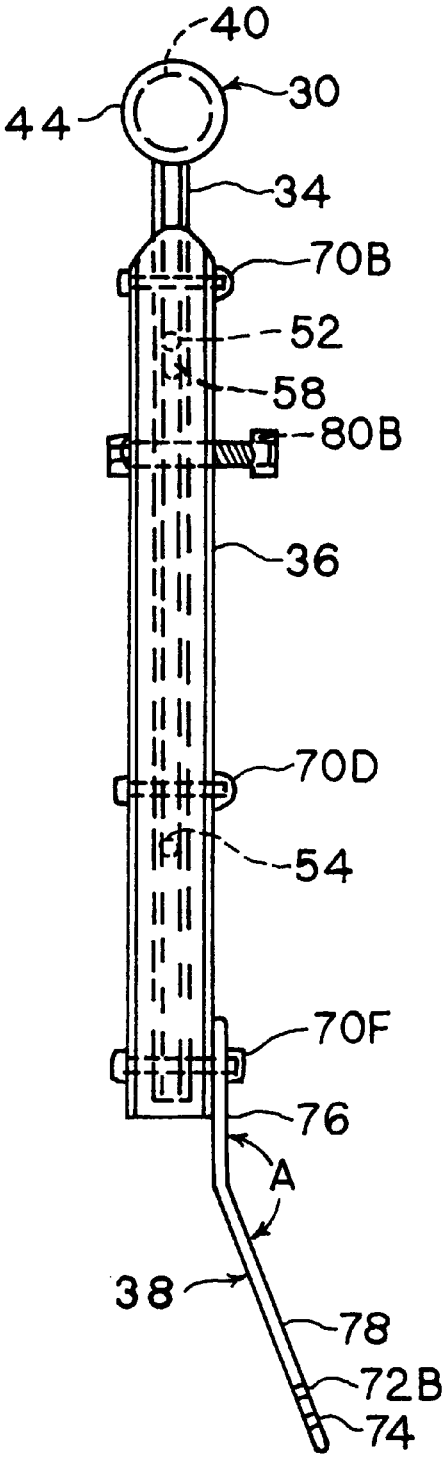
FIG. 4 shows a side elevation view of the brace assembly of FIG. 2, including a first embodiment of the mounting bracket.

Referring to FIGS. 2 and 4, engagement structure 30 includes a grip element 40 mounted to support column 34 and first and second hand grips 42, 44 mounted to grip element 40. The top end of support column 34 is cooperatively configured to receive and interface with the generally cylindrical contour of grip element 40. Grip element 40 can have other contours as desired, in which case the top end of support column 34 is preferably adapted to such other contours.

Grip element 40, as well as support column 34, can be made from a variety of plastics, metals, or other materials having suitable strength properties and characteristics. A preferred material is a plastic, namely an acetal sold under the trade name Delrin®. Delrin® has water absorption of about 0.25% by weight at 24 hours, compressive strength of about 18,000 pounds per square inch, tensile strength of about 10,000 pounds per square inch, good bending resistance, good impact resistance, good abrasion resistance, and an acceptably low coefficient of friction.

First and second hand grips 42, 44 preferably comprise resilient cushioning foam sleeves overlying and generally encompassing grip element 40. Hand grips 42, 44 preferably are sized to permit the hands of a typical adult user to extend about at least half of the outer circumference of the respective hand grip. More preferably, the hand grips have a diameter of from about 0.75 inch to about 1.5 inches, and still more preferably from about 0.87 inch to about 1.25 inches, whereby the hands of a typical adult can extend entirely about the outer circumference of the respective hand grip. Bicycle grips and other grips known in the art may be substituted for the above disclosed hand grips assuming the size and material are such that the hands of a typical adult user can readily get an effective stabilizing grip on grip element 40 by grasping the respective hand grips 42, 44 installed on grip element 40.

The leading edges of first and second hand grips 42, 44 preferably are configured to fit about the outline of support column 34. A small space 45 is shown in FIG. 2 between hand grips 42, 44 for illustration purpose only, thus to enhance visual distinction in FIG. 2 between hand grip 42 and hand grip 44. Thus, first and second hand grips 42, 44 are mounted on grip element 40 by pushing hand grips 42, 44 onto the grip element from opposing ends thereof, and then pushing the respective hand grips toward the center of the grip element. When properly and fully mounted, first and second hand grips 42, 44 have the general appearance of a single solid cushioned grip extending over substantially the entire surface of grip element 40. Hand grips 42, 44 as seen in FIG. 2 are properly mounted as far as they extend, but need to be pushed toward each other in order to be fully mounted.

HEIGHT ADJUSTMENT APPARATUS

Height adjustment apparatus 32 can be used to enable desired movement of engagement structure 30 between at least a lowered position shown in FIG. 2 and a higher raised position illustrated in FIGS. 1 and 11, and to control such raising and/or lowering movement. As shown in FIG. 2, height adjustment apparatus 32 includes a knob 46, lock pin 48 extending from knob 46, and retention spring 50. Height adjustment apparatus 32 interacts with first and second respective upper and lower apertures 52, 54 in support column 34 (FIGS. 2 and 4).

As shown in FIG. 2, fastener 56 secures spring 50 to support housing 36. Lock pin 48 is secured to knob 46. In the lowered position shown in FIG. 2, lock pin 48 extends through aperture 57, in support housing 36 and thence into blind aperture 52 in a side of support column 34. Aperture 57 is open on both ends. Withdrawing knob 46 away from support housing 36 withdraws lock pin 48 from the respective aperture 52, 54 of support column 34 and thus enables movement of the support column in an upward or downward direction. When the respective raised height or lowered height has been reached, the inward bias of spring 50 toward support column 34 urges lock pin 48 to enter the respective aperture 52, 54 of the support column. Such entry of lock pin 48 into aperture 54 locks engagement structure 30 against upward or downward movement of support column 34. Entry of lock pin 48 into aperture 52 locks the engagement structure against downward movement of support column 34.

By pulling back on knob 46 (away from support housing 36) and thereby retracting lock pin 48 from the respective aperture, support column 34 can be moved to another position (e.g. higher or lower) relative to support housing 36.

Assuming that the lowered height of engagement structure 30 is within about two inches of the height of top support surface 18 of the seat, the raised height of engagement structure 30 wherein lock pin 48 is in aperture 54 preferably is from about 5 inches to about 12 inches above the height of the engagement structure at a lowered position (e.g. wherein lock pin 48 is disposed in aperture 52). The raised height of engagement structure 30 most preferably is from about 8 inches to about 9 inches above the lowered height thereof. In preferred embodiments, the lowered height is low enough to enable a rider to readily climb onto the watercraft from the rear, including easily passing over the lowered engagement structure while maintaining a low profile, with a low center of gravity generally consistent with the height of the center of gravity when sitting on the seat of the personal watercraft. Maintaining a low center of gravity is desired because personal watercraft in general have a tendency to tip over.

A plurality of blind apertures may be employed in support column 34 between the heights of apertures 52 and 54, for locking the column at intermediate heights. See, for example, the six apertures 55 in side surface 66B (described more fully hereinafter). Apertures 55 can be accessed and used by pulling support column 34 up entirely out of support housing 36, rotating the support column 180 degrees about longitudinal axis 59, and reinserting the support column back into opening 69. Such rotation brings side surface 66B into engaging relationship with lock pin 48, thus to lock grip element 40 at a desired height corresponding to any one of the six apertures 55.

Aperture 52 is a generally circular, blind hole as preferably are apertures 55. The lower side of aperture 52, namely that side disposed toward aperture 54, includes a ramp 58, preferably a ramp having an arcuate surface thereto, extending from substantially the full depth of the hole to the surface of column 34 adjacent and below the hole. See FIGS. 2 and 4.

Ramp 58 is effective to urge and dispose pin 48 outwardly of aperture 52 when engagement structure 30 is forcefully pulled in an upward direction. This feature allows the rear-facing passenger/rider to raise engagement structure 30 from a lowered position (lock pin 48 in aperture 52, FIG. 2) to a raised position (FIG. 1) wherein lock pin 48 is in aperture 54 without actually manipulating lock pin 48 such as with knob 46. To that end, as a user lifts on hand grips 42, 44 (without touching knob 46) the lift force of column 34 as applied at ramp 58 urges/pushes lock pin 48 out of aperture 52, thereby releasing pin 48 from aperture 52. Thus can the engagement structure be raised until aperture 54 is aligned with aperture 57 and lock pin 48, whereupon the restoration force in spring 50 moves pin 48 into aperture 54, thus locking support column 34, and correspondingly engagement structure 30, in the raised position.

Aperture 54 has no ramp corresponding to ramp 58. Thus, a separate outward-directed force is required as at knob 46 in order to release lock pin 48 from aperture 54. The engagement of structure 30 with pin 48 is used in the raised position to provide a generally immobile support to the rear-facing rider at a height approximately at the waist and/or center of gravity of an adult user.

Thus, aperture 54 must not have any ramp which would enable upward or downward movement of engagement structure 30 without manipulation of knob 46 lest the required immobilization of engagement structure 30 be jeopardized. Applicant contemplates that the center of gravity of an adult user is at about the middle of the height of the torso.

Spring 50 may comprise a plastic such as acetal, described earlier for support column 34 and grip element 40. The width and thickness of leaf spring 50 are selected so that the spring has the proper flexibility and resilience to automatically move lock pin 48 into the respective aperture (e.g. 52, 54) when the aperture comes into alignment with pin 48. Other arrangements, such as for example, metallic leaf springs, or a spring mounted in aperture 57, can be utilized to move lock pin 48 into a respective aperture 52, 54.

Lock pin 48 preferably comprises a metallic material. However, other materials having sufficient strength can be substituted for the metallic material.

SUPPORT COLUMN AND SUPPORT HOUSING

Support column 34 is slidable upwardly and downwardly within support housing 36 thus to move engagement structure 30 to a selected raised position or lowered position.

For purpose of providing sufficient strength, support column 34 is preferably a single solid (not hollow) unitary element made of plastic material such as acetal, as described earlier. Other structures, including hollow structures, may be used so long as such structures provide the required strength to enable the brace assembly to properly stabilize the rider.

Figure 3:
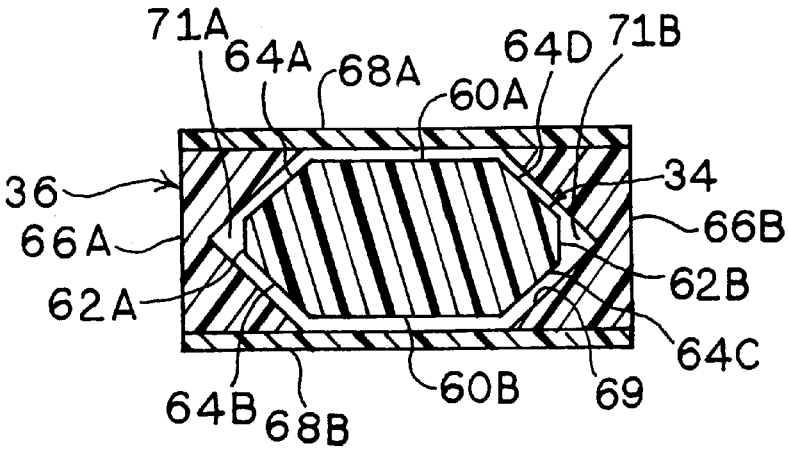
FIG. 3 shows cross-sectional view of the brace assembly of FIG. 2 taken at line 3—3 of FIG. 2.

As shown in the cross-sectional view of FIG. 3, support column 34 preferably has an eight-sided outline including first and second elongate flat front and rear surfaces 60A, 60B, respectively, third and fourth short elongate flat left and right side surfaces 62A, 62B respectively, and fifth, sixth, seventh, and eighth elongate corner surfaces 64A–64D. Corner surfaces 64A–64D represent bevels of the otherwise right angle corners at intersections of the front and rear surfaces with the respective left and right side surfaces. The surfaces of the unitary element which comprises support column 34 are all generally flat, thereby to be received into support housing 36 with alignment of the respective surfaces on support column 34 with corresponding surfaces on support housing 36.

As discussed earlier, blind apertures 52, 54 extend into the support column from side surface 62A, and in the brace assembly, are aligned with corresponding aperture 57 in support housing 36 for receiving lock pin 48 through aperture 57 and into the respective blind aperture 52 or 54.

Support housing 36 preferably is made of a plastic material such as acetal. Support housing 36 includes first and second side elements 66A, 66B. In the preferred embodiment, first and second side elements 66A, 66B are formed as a result of careful cutting of support column 34 from an elongate rectangular block of the plastic. In this manner, generally the material cut away from the rectangular block in making support column 34 is used as side elements 66A, 66B, thus controlling the amount of scrap generated by the manufacturing process while obtaining a high strength value, given the amount of raw materials used.

Front and rear cover elements 68A, 68B respectively are secured to respective side elements 66A, 66B at appropriate spaced locations along the corresponding lengths of the side elements and cover elements by bolts 70A–70F, thereby defining opening 69. Opening 69 is bounded by cover elements 68A, 68B and side elements 66A, 66B, extends along the entire length of support housing 36, and is open on both ends. Cover elements 68A, 68B are preferably made from the same material as side elements 66A, 66B, namely e.g. acetal.

FIGS. 2 and 4 show bolts 70A–70F, including self locking nuts, securing cover elements 68A, 68B to first and second side elements 66A, 66B. Cover elements 68A, 68B can, in the alternative, be secured to side elements 66A, 66B, by any of a variety of securing mechanisms, for example, screws, other mechanical fasteners, adhesives, or other securement to form support housing 36, including opening 69.

Internal opening 69 preferably has a six-sided configuration to receive the eight-sided support column 34. Any number of exterior sides can be utilized on support column 34, and any number of interior sides can be used on support housing 36 to form opening 69, so long as the support column is cooperatively and slidably supported in the support housing. As illustrated in FIG. 3, support column 34 may have more sides, or fewer sides, than support housing 36. What is important is that support column 34 fit securely within opening 69, for preferably frictional sliding engagement with the surfaces of opening 69.

Other respective shapes can be utilized for both support column 34 and support housing 36. However, generally smooth sides and edges are preferred for both support column 34 and the respective receptive support housing 36, preferably accompanied by frictional engagement between support column 34 and support housing 36.

Left and right side surfaces 62A, 62B space support column 34 from respective corners 71A, 71B, thus to reduce the likelihood that a close-fitting support column 34 might bind in corners 71A, 71B. Thus support column 34 can slide within support housing 36, accompanied by frictional engagement between support column 34 and support housing 36.

Other plastics, and other materials such as metals, can be utilized in making support column 34 and support housing 36, provided the materials have sufficiently low coefficients of friction, or are lubricated to have sufficiently low coefficients of friction to facilitate manual sliding movement of support column 34 between the lowered and raised positions, or where sufficient clearance is provided between support column 34 and support housing 36 to facilitate such sliding engagement. Further, any material so used must provide sufficient strength to support column 34 and support housing 36, in the configuration used, thereby to support the full force imposed on engagement structure 30 by an adult rider on the personal watercraft, such as when the watercraft accelerates in pulling a water skier.

For example, at full acceleration from stop, much of the weight of the spotter is urged against grip element 40, and is transferred through support column 34 and support housing 36 to the central body portion 73 of the personal watercraft. While support housing 36 may receive structural support from boarding handle 24, depending on the particular attachment of a given brace assembly to a particular personal watercraft, support column 34, in general receives, and must bear, the full stress applied at grip element 40. Thus, the structural strength of support column 34 is critical. An exemplary such support column 34, found acceptable in this regard is DELRIN® acetal 0.87 inch wide across surfaces 60A, 60B, and 0.75 inch thick between surfaces 60A, 60B.

Overall, both support column 34 and support housing 36 need be strong enough that the combination of the two elements receives and tolerates forces imposed by the rear-facing rider 75R as illustrated in FIG. 11. Note by comparison the similar support conventionally available to the driver 75D through control console 77.

Except at corners 71A, 71B, the space shown between support column 34 and support housing 36 in FIG. 3, about the perimeter of column 34, is shown only for purposes of illustration. The space between the elements comprising support column 34 and support housing 36 can be more or less, preferably less, than the space illustrated, in order to obtain a desired frictional but sliding engagement between support column 34 and support housing 36.

MOUNTING APPARATUS

Mounting apparatus, including mounting bracket 38 secures support housing 36 to personal watercraft 14 at a rearwardly-disposed location. Mounting bracket 38, shown in FIGS. 2 and 4, includes first and second mounting apertures 72A, 72B for mounting to the personal watercraft either underlying or overlying (preferably underlying) tow eye 26. Tow eye 26 is typically a U-bolt.

Mounting bracket 38 also includes an outlet aperture 74, shown in FIG. 2, aligned with a corresponding leg of tow eye 26, facilitating egress of engine cooling water from the watercraft. Mounting bracket 38 has a first section 76 and a second section 78. As illustrated in FIG. 4, an obtuse angle "A" of from about 160 degrees to about 170 degrees is formed between first and second sections 76, 78 of bracket 38. Thus, when brace assembly 28 is mounted on a personal watercraft, the slope of second section 78 of bracket 38 preferably conforms to the rear surface 81 of upwardly extending central body portion 73 at the locus of mounting of tow eye 26 to the central body portion.

As shown in FIGS. 2 and 4, bolts 70E, 70F secure first section 76 of bracket 38 to support housing 36 through appropriate apertures in bracket 38 and support housing 36. Thus, bracket 38 is a functional element of brace assembly 28.

Assuming tow eye 26 has been previously installed on central body portion 73, the first step in mounting brace assembly 28 to the personal watercraft is to remove the tow eye. Brace assembly 28 is then positioned on the watercraft generally as shown in FIG. 1, with first and second mounting apertures 72A, 72B aligned with respective apertures in the central body portion at the location of mounting of the tow eye, and with the upper portion of brace assembly 28 between boarding handle 24 and rear of the seat. Tow eye 26 is then repositioned over bracket 38. Legs of tow eye 26 are aligned with respective holes in bracket 38 and in the hull/floatation body, and are installed in the holes, using suitable fasteners. In this manner, brace assembly 28 is secured to the personal watercraft using the holes already existing for mounting of the tow eye.

The mounting apparatus further includes fasteners 80A, 80B located at an upper portion of support housing 36. Fasteners 80A, 80B comprise machine screws or the like joining support housing 36, at an upper portion thereof, to boarding handle 24. As shown in FIG. 1, during installation, support housing 36 is placed in a space between rear 81 of central body portion 73 of the hull/floatation body, and the rear transverse run of boarding handle 24. Fasteners 80A, 80B preferably mount support housing 36, and thus the entire brace assembly 28, to the forwardly-disposed edge of boarding handle 24.

In other embodiments, the direction of fasteners 80A, 80B is reversed such that the fasteners secure support housing 36 to the rear 81 of central body portion 73. Such securement is preferably made at about the same height as the above-described securement to boarding handle 24. However, fasteners 80 are not limited to such a location. Any location where support housing 36 contacts, or is proximate rear 81 of personal watercraft 14, is acceptable for fasteners 80A, 80B to secure brace assembly 28 to the watercraft.

While first and second fasteners 80A, 80B, are illustrated in FIG. 2, a single fastener, or more than two spaced fasteners are contemplated as acceptable for securing the brace assembly to an upper location on the central body portion. Preferably at least two fasteners 80 are utilized, in combination with mounting bracket 38, to provide support for brace assembly 28 at a lower location on rear 81 of the central body portion. Other means for securing brace assembly 28 to the personal watercraft, generally at or close to rear 20 of seat 16, will now be obvious to those skilled in the art.

The mounting apparatus illustrated in FIGS. 2 and 4 generally mounts brace assembly 28 to SEADOO® type personal watercraft and other watercraft having the size and orientation of tow eye 26 shown in FIG. 1.

Figure 5:
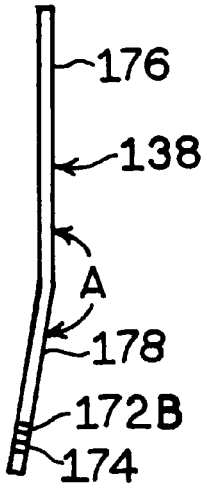
FIG. 5 shows a side view of a second embodiment of the mounting bracket.

Another embodiment of the mounting bracket, indicated as 138 in FIG. 5, has first section 176 and second section 178. In this embodiment, mounting bracket 138 has similar apertures 172A, 172B, 174 at similar locations, thus imparting characteristics similar to those of mounting plate 38 of the embodiment of FIGS. 2 and 4. The main difference in the bracket in the embodiment of FIG. 5 is the size of angle "A". In mounting bracket 138, angle "A" is greater than 180 degrees, for example about 190 degrees to about 200 degrees, such that bracket 138 of FIG. 5 properly aligns with the surface of other brands of personal watercraft 14 at tow eye 26. A desirable feature about the mounting bracket, whether 38 or 138, is that section 78 (or 178) be generally effectively co-planar with the rear of central body portion 73 at the locus of mounting the bracket to the central body portion.

The mounting apparatus illustrated in FIG. 5 mounts brace assembly 28 to a different variety of personal watercraft than the mounting plate shown in FIGS. 2 and 4. Thus, the magnitude of angle "A" is specified to compliment, and to align with, the respective rear surface of the watercraft to which the brace assembly is to be mounted. Thus, angle "A" as illustrated is exemplary only, and is preferably specified for each watercraft model to compliment the orientation of the central body portion of the respective personal watercraft at the locus of mounting the bracket to the personal watercraft.

Figure 6:
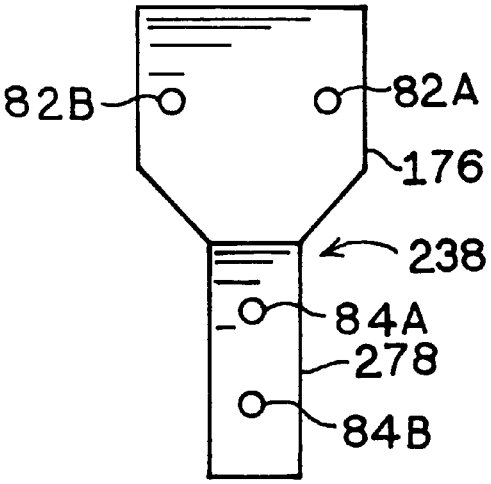
FIG. 6 shows a front view of a third embodiment of the mounting bracket.

A third embodiment of the mounting bracket is illustrated in FIG. 6. In this embodiment, mounting bracket 238 has first and second mounting apertures 82A, 82B for mounting the bracket to support housing 36. Mounting bracket 238 also has third and fourth mounting apertures 84A, 84B for mounting with a tow eye such as eye 26. As shown in FIG. 6, third and fourth mounting apertures 84A, 84B are in vertical alignment for mounting with a tow eye having a vertically aligned eyelet and respective vertically aligned mounting apertures. Further, the width of second section 178 is narrowed from the width of first section 176, in order to conform to the shape of the rear surface of central body portion 73 of the personal watercraft to which the bracket may thus be mounted.

The variation in the angle between first and second sections 176, 178 in FIG. 6, depends on the corresponding structure of the personal watercraft at the locus where brace assembly 28 is installed.

As new models of personal watercraft are manufactured, mounting bracket 38 can be varied, as necessary, to fit the particular style and configuration of the personal watercraft at the rear of the central body portion of the respective watercraft.

NON-INVASIVE MOUNTING APPARATUS

Figure 7:
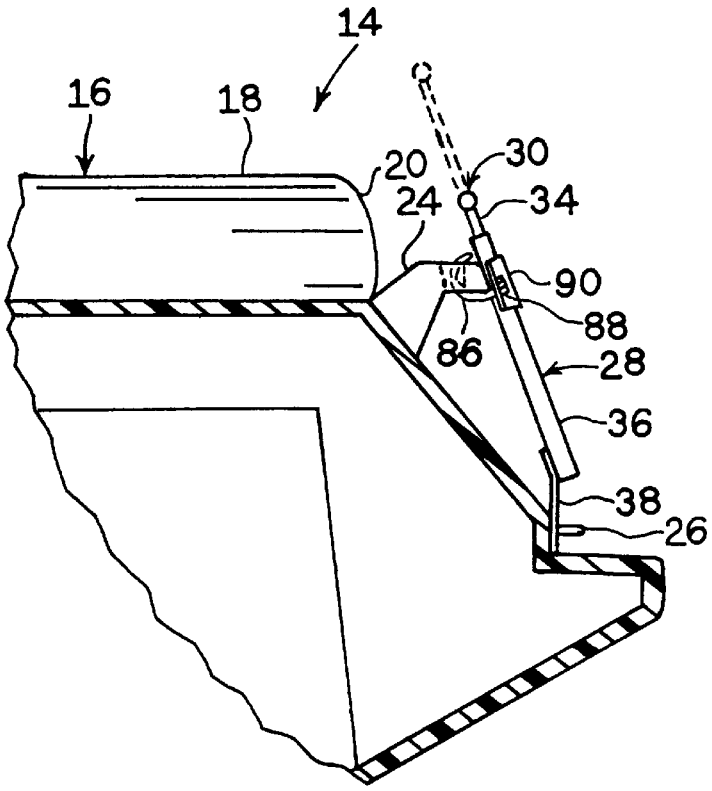
FIG. 7 shows a cutaway view of the rear portion of a personal watercraft of the invention including a second embodiment of the brace assembly.
Figure 8:
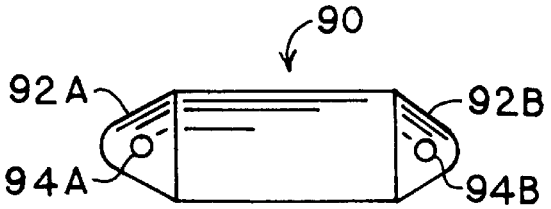
FIG. 8 shows a front view of a hook-bolt support bracket used in the embodiment of FIG. 7.
Figure 9:
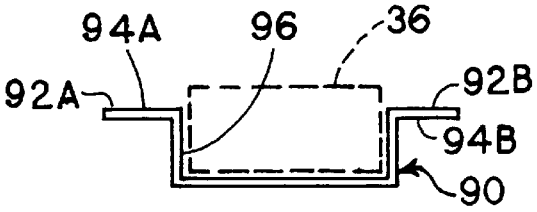
FIG. 9 shows a top view of the hook-bolt support bracket of FIG. 8.

FIGS. 7–9 illustrate a second embodiment of the invention including non-invasive mounting apparatus such that removal of brace assembly 28 leaves no damage, no apertures and no bolt holes, on the body of the personal watercraft specific only to the brace assembly. Namely, the brace assembly is mounted to the watercraft body without making any new holes in the body. Since no new holes are created, the brace assembly is mounted without "creating" any invasion of the watercraft body.

FIG. 7 shows brace assembly 28 installed at or adjacent rear 81 of the central body portion of personal watercraft 14. In this embodiment, support housing 36 is located to the rear of boarding handle 24, rather than in the space between the boarding handle and rear 20 of the seat. Hook-bolt 86 and hook-bolt mounting bracket 90 secure support housing 36, and thus brace assembly 28, to boarding handle 24. While only a single hook-bolt 86 is illustrated in FIG. 7, first and second hook-bolts are contemplated on opposing sides of support housing 36, secured to first and second ends 92A, 92B of hook-bolt mounting bracket 90 by nuts 88. As illustrated in FIG. 7, each hook-bolt 86 extends frontwardly and upwardly, and thence up and to the rear, about boarding handle 24. Hook-bolt nuts 88 are tightened such that hook-bolts 86 securely retain support housing 36, and thus brace assembly 28, against boarding handle 24.

As shown in FIG. 8, first and second ends 92A, 92B of hook-bolt mounting bracket 90 include first and second apertures 94A, 94B which receive hook-bolts 86. First and second hook-bolts 86 are mounted about boarding handle 24 and are thereby secured to personal watercraft 14. The combination of mounting the brace assembly to the watercraft, at bracket 38 using (a) in common with tow eye 26 of personal watercraft 14, and (b) hook-bolts 86 about boarding handle 24, provides a non-invasive method of mounting brace assembly 28 to personal watercraft 14, such that no new holes/apertures need ever be made in the watercraft to enable mounting the brace assembly.

Figure 10:
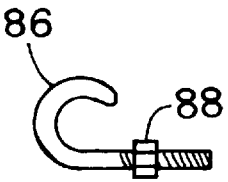
FIG. 10 shows an example of a hook-bolt and corresponding nut useful with the invention.

The top view of bracket 38 at FIG. 9 shows opening 96 between ends 92A, 92B of the hook-bolt mounting bracket. Opening 96 receives support housing 36 thereinto as illustrated in dashed outline. As contemplated by the inventor herein, support housing 36 preferably fits snugly within opening 96. Hook-bolt mounting bracket 90 can be bolted, glued, or otherwise fixed to support housing 36, as desired, or may be temporarily held thereto only by the engagement of cover element 68A and hook-bolts 86 against boarding handle 24. FIG. 10 shows a typical hook-bolt 86 and hook-bolt nut 88.

The above description illustrates that no invasive fasteners are required for the embodiment described above, whereby the user of the watercraft can readily secure and/or remove brace assembly 28 at e.g. the illustrated upper and lower locations without the use of an additional number of fasteners invasive into the hull or other body portion of the watercraft.

While FIG. 7 shows support housing 36 located to the rear of boarding handle 24, the support housing can be located in the space of boarding handle 24 as shown in the embodiment of FIG. 1, still with hook-bolts 86 around the boarding handle. Other variations to fit future designs of new models of personal watercraft will now be obvious to those skilled in the art.

Figure 12:
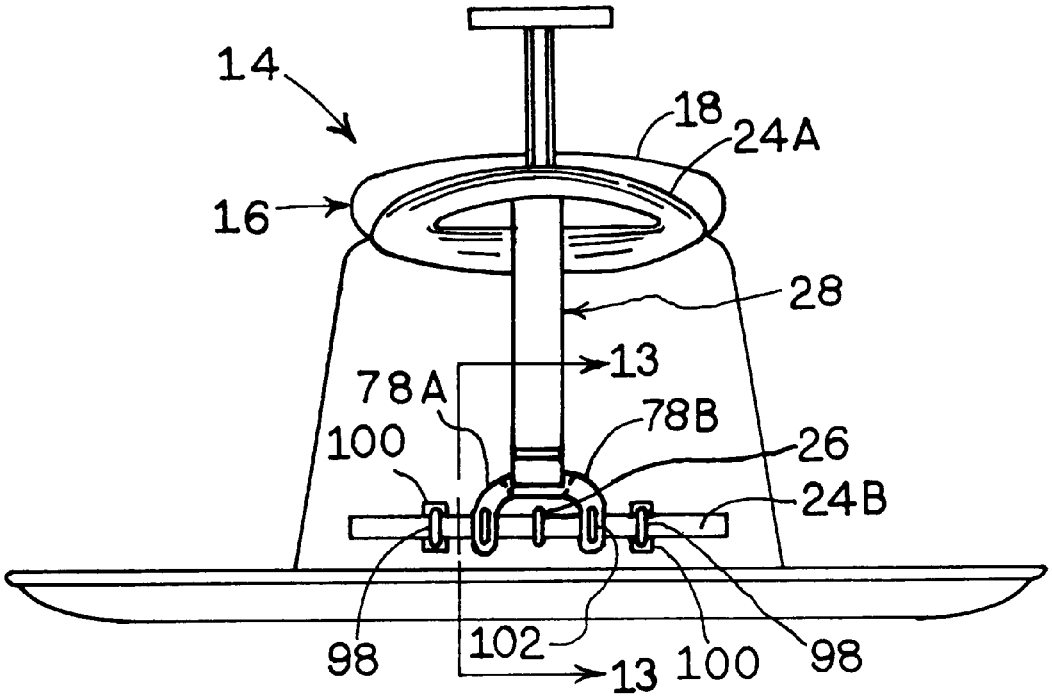
FIG. 12 shows a representative rear elevation of a third embodiment of personal watercraft and brace assemblies of the invention.
Figure 13:
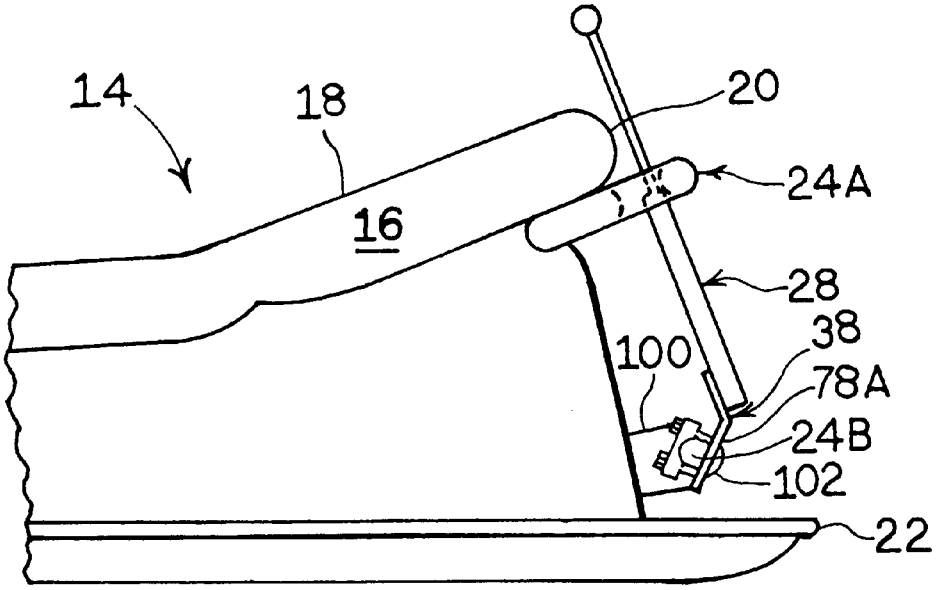
FIG. 13 shows a side view of a rear portion of the personal watercraft, including the brace assembly, of FIG. 12.

FIGS. 12–13 illustrate a third embodiment of brace assembly 28, mounted on a personal watercraft. In this embodiment, the above discussed boarding handle is indicated as 24A. A horizontal bar 24B is mounted on the central body portion of the watercraft by U-bolts 98, and is spaced from the central body portion by spacers 100. Bar 24B operates as a secondary boarding assist. Namely, because bar 24B is closer to the water than boarding handle 24A, bar 24B is easier for a person to reach while still fully in the water.

In FIGS. 12 and 13, towing eye 26 is mounted to bar 24B at a central location thereof. In brace assembly 28, bracket 38 includes a pair of legs 78A, 78B which are joined to bar 24B by U-bolts 102. The upper portion of brace assembly 28 is mounted to the watercraft in the space between the front of boarding handle 24A and rear 20 of the seat.

As in the embodiment of FIGS. 7–9, in the embodiment of FIGS. 12–13, the brace assembly may be mounted to the watercraft, not only without adding any holes to the watercraft body. Further, in this embodiment, no fastener used to mount the brace assembly invades the watercraft body for holding the brace assembly to the watercraft. Thus, while the brace assembly of FIGS. 7–9 is mounted to the personal watercraft without "creating" any invasion, the brace assembly of FIGS. 12–13 is mounted to the personal watercraft without any invasion whatsoever of the body of the personal watercraft.

FIG. 13 further illustrates the positioning of the engagement structure 30 vertically over a portion of the top surface of the seat. With the engagement structure so positioned forwardly of the rear of the seat, the engagement structure automatically engages the torso of a rear-facing adult rider, and holds the rider away from the rear of the seat, whereby the rider will not readily be wedged between the brace assembly and the rear of the seat.

Figure 14:
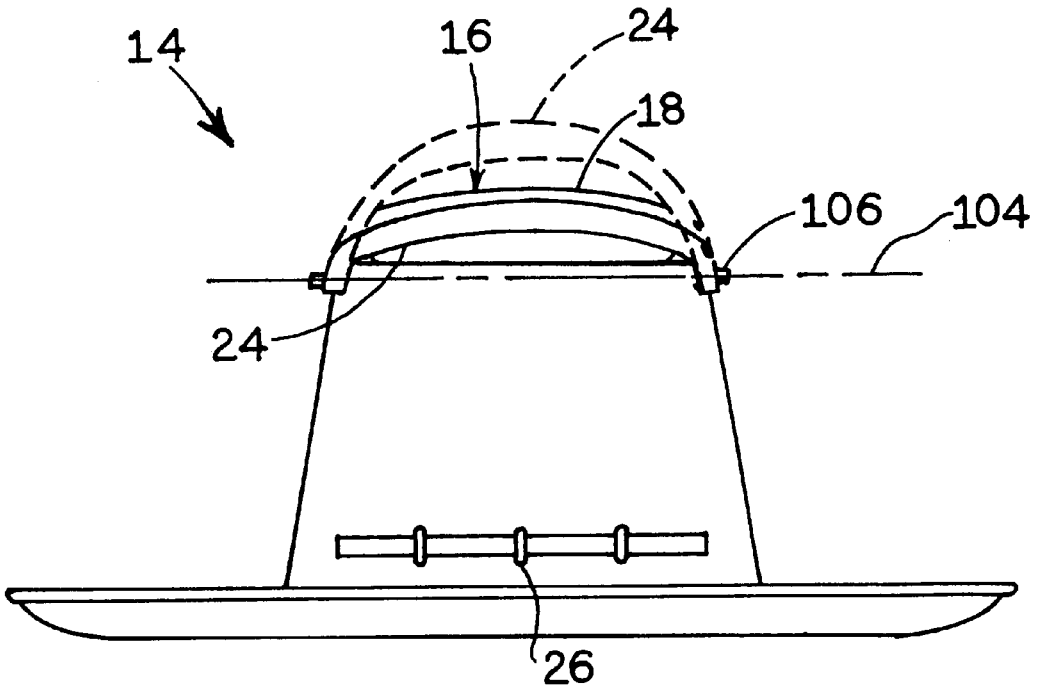
FIGS. 14 and 15 are rear and side partial views respectively of a fourth embodiment of personal watercraft and brace assemblies of the invention.
Figure 15:
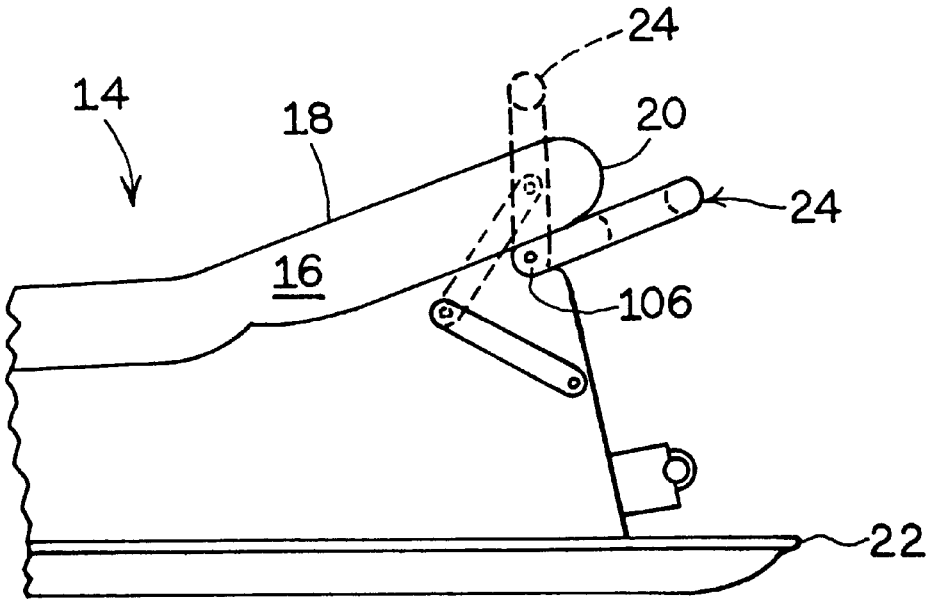

FIGS. 14–15 illustrate a fourth embodiment of the invention. In this embodiment, boarding handle 24 is mounted for pivotation with respect to central body portion 73, about a generally horizontal axis 104. To that end, boarding handle 24 is mounted to central body portion 73 by a pivot shaft 106. As illustrated in FIG. 15, boarding handle 24 pivots between a lowered position shown in solid outline and a raised position shown in dashed outline. Support brace 108 supports and holds boarding handle 24 in the raised position such that boarding handle thus serves the same purpose as grip element 40 in the previous embodiments. when locked in the position shown in solid outline in FIGS. 14–15, boarding handle 24 may be used in the conventional manner for assist in boarding the personal watercraft.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said brace assembly comprising height adjustment apparatus effective to control raising and lowering the height of said engagement structure between a first raised position and a second lowered position above the top surface of the seat, thereby enabling the rear-facing rider to engage said engagement structure substantially above the height of the top surface of the seat, said height adjustment apparatus comprising a spring active to urge a lock pin into an aperture in said support column thereby to retain said engagement structure at a fixed height.

2. A brace assembly as in claim 1, said height adjustment apparatus being effective to automatically stop downward movement of said engagement structure from the raised position, and to automatically release said lock pin from said aperture when said engagement structure is pulled upwardly from the lowered position.

3. A brace assembly as in claim 2, said height adjustment apparatus comprising a spring active to urge a lock pin into an aperture in said support column thereby to retain said engagement structure at a fixed height.

4. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said brace assembly comprising height adjustment apparatus effective to control raising and lowering the height of said engagement structure between a first raised position and a second lowered position above the top surface of the seat, thereby enabling the rear-facing rider to engage said engagement structure substantially above the height of the top surface of the seat, said support column being mounted inside said support housing such that a first set of effectively planar surfaces on said support column slide in facing relationship against a respective second set of effectively planar surfaces of said support housing.

5. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said brace assembly including a mounting bracket, said mounting bracket comprising a mounting plate having a length and a width, said mounting plate comprising apertures facilitating mounting of said mounting plate in combination with a tow eye on the personal watercraft.

6. A brace assembly as in claim 5, said mounting plate having first and second sections defining an obtuse angle therebetween, the obtuse angle between said first and second sections being from about 160 degrees to about 170 degrees.

7. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said brace assembly comprising height adjustment apparatus effective to control raising and lowering the height of said engagement structure between a first raised position and a second lowered position above the top surface of the seat, thereby enabling the rear-facing rider to engage said engagement structure substantially above the height of the top surface of the seat, said brace assembly including a mounting bracket, said mounting bracket comprising a mounting plate having a length and a width, said mounting plate having first and second sections defining an obtuse angle therebetween, said mounting plate comprising apertures facilitating mounting of said mounting plate in combination with a tow eye on the personal watercraft, said brace assembly, including said mounting bracket, having an overall length of between about 15 inches and about 20 inches when said support column is at a lowered height.

8. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said engagement structure comprising a grip element having a length, the length of said grip element extending substantially transversely across said support column, said grip element including first and second hand grips extending in opposing directions away from said support column, thereby enhancing ability of a rear-facing rider on the personal watercraft to grip the first and second hand grips with respective first and second hands and thereby to securely grip said grip element.

9. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said brace assembly including a mounting assembly comprising a hook-bolt for extending about the boarding handle and thereby mounting said brace assembly to the boarding handle of the personal watercraft without invading the personal watercraft.

10. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing rider straddle the seat with their legs when on the watercraft seat, said brace assembly comprising:

(a) engagement structure to be grasped by such rear-facing rider;

(b) a support column having a first length, said support column supporting said engagement structure; and (c) a support housing having an opening receiving said support column, said support housing, said support column, and said engagement structure, in combination, being sufficiently strong to receive body weight of a rear-facing adult rider at said engagement structure, and thereby to provide sufficient strength to enable such rear-facing adult rider to stabilize himself during normal operation of the personal watercraft, said brace assembly comprising a hook-bolt for securing said brace assembly to the personal watercraft.

11. A personal watercraft having a front and a rear, said personal watercraft comprising:

(a) a hull comprising a floatation body;

(b) drive and control apparatus;

(c) a longitudinally-extending seat, said seat having a top surface and a rear; and (d) a brace assembly mounted on said personal watercraft adjacent the rear of said seat, and extending upwardly adjacent said seat, said brace assembly comprising engagement structure having a horizontally-disposed grip element corresponding to a size of up to about 1.5 inch diameter and accessible to be gripped from a front side thereof, said grip element extending substantially above the height of the top surface of the longitudinally-extending seat, said grip element providing support such that a rear-facing rider straddling said seat can readily grip said grip element from the front side of the grip element and above the top surface of the seat and thereby stabilize himself on said personal watercraft during normal operation of the personal watercraft.

12. A personal watercraft as in claim 11, said brace assembling further comprising a support column and a support housing, said support column having a first end and a second end, said first end supporting said grip element and said support housing having an opening receiving said second end of said support column, said support column being slidably mounted inside said opening in said support housing.

13. A personal watercraft as in claim 12, said support housing having a substantially closed perimeter for slidably receiving said support column.

14. A personal watercraft as in claim 12, said brace assembly further comprising height adjustment apparatus for raising and lowering said engagement structure between a first raised position and a second lowered position above the top surface of said seat, thereby enabling the rear-facing rider to grip the engagement structure substantially above the seat.

15. A personal watercraft as in claim 12, said support housing being mounted to said personal watercraft by a mounting bracket secured to a lower end of said support housing.

16. A personal watercraft as in claim 15, said mounting bracket comprising a mounting plate having first and second sections defining an obtuse angle therebetween, said mounting plate comprising apertures for mounting said mounting plate to a tow eye on the personal watercraft.

17. A personal watercraft as in claim 16, said brace assembly, including said mounting bracket, having an overall length of between about 15 inches and about 20 inches when said support column is at the lowered position.

18. A personal watercraft as in claim 11, wherein said grip element includes first and second hand grip extending from opposing sides of said support column.

19. A personal watercraft as in claim 12, said brace assembly comprising securing apparatus operative to secure the combination of said support housing and said support column to the personal watercraft at at least two spaced locations adjacent the rear of the seat without creating any new structural invasion of the personal watercraft.

20. A personal watercraft as in claim 11, said personal watercraft having an upstanding central body portion supporting said seat, and having a boarding handle mounted adjacent the rear of said seat, said brace assembly extending upwardly through an opening defined between said boarding handle and said central body portion.

21. A personal watercraft as in claim 11, said brace assembly be ing mounted at an angle to the vertical such that said engagement structure extends over the top surface of said seat.

22. A personal watercraft as in claim 12, said brace assembly comprising securing apparatus operative to secure the combination of said support housing and said support column to said personal watercraft at the rear of the seat without creating any new structural invasion of said personal watercraft.

23. A personal watercraft as in claim 22 having a structural member pre-mounted on said personal watercraft, said brace assembly comprising a hook-bolt for securing said brace assembly to said structural member of said personal watercraft.

24. A personal watercraft as in claim 12, said brace assembly comprising securing apparatus including upper and lower fastening members for securing one of said support housing and said support column to said personal watercraft without any new structural invasion of the hull, including the floatation body of said personal watercraft.

25. A personal watercraft as in claim 11, said brace assembly comprising securing apparatus including upper and lower fastening members effective to secure vertically spaced locations on said brace assembly to said personal watercraft.

26. A brace assembly for mounting at or adjacent a rear end of a personal watercraft, the personal watercraft having a longitudinally-extending seat for use by a rear-facing rider on the personal watercraft, said brace assembly comprising:

(a) engagement structure having a grip element corresponding to a size of up to about 1.5 inches diameter and accessible to be gripped from a front side thereof;

(b) an upwardly extending support column supporting said engagement structure at a height which is above the seat of the personal watercraft, the combination of the size of the engagement structure, the accessibility of the engagement structure to be gripped from the front, and the height of the engagement structure above the seat providing a suitable-sized grip element in a location and so configured to facilitate use by such rear facing rider for stabilizing himself.

27. A brace assembly as in claim 26, said brace assembling comprising an upwardly extending support housing having an opening for slidably receiving said support column.

28. A brace assembly as in claim 27, a first set of effectively planar surfaces on said support column sliding in facing relationship against a respective second set of effectively planar surfaces of said support housing.

29. A brace assembly as in claim 26, said brace assembly comprising height adjustment apparatus effective to control raising and lowering height of said engagement structure between a first raised position and a second lowered position no more than about 2 inches above the top surface of the seat, thereby enabling the rear-facing rider to engage the engagement structure substantially above the seat.

30. A brace assembly as in claim 29, said height adjustment apparatus comprising a lock pin seated in an aperture, said height adjustment apparatus automatically preventing downward movement of said engagement structure from the raised position, and automatically releasing said lock pin from said aperture when said engagement structure is pulled upwardly from the lowered position.

31. A brace assembly as in claim 30, said aperture comprising a downwardly-extending ramp effecting the automatic release.

32. A brace assembly as in claim 26, said engagement structure comprising a grip element having a length, the length of said grip element extending substantially transversely across said support column, said grip element including first and second hand grips extending from adjacent opposing sides of said support column, thereby facilitating a rear-facing rider on the personal watercraft gripping the first and second hand grips with respective first and second hands and thereby securely gripping said grip element.

33. A brace assembly as in claim 27, said brace assembly comprising securing apparatus operative secure the combination of said support housing and said support column to the personal watercraft at at least two spaced locations adjacent the rear of the seat without creating any new structural invasion of the personal watercraft.

34. A brace assembly as in claim 26, said support column comprising a single upwardly extending support column providing substantially all support supporting said engagement structure.

35. A personal watercraft comprising:

(a) a hull comprising a floatation body;

(b) drive and control apparatus;

(c) a longitudinally-extending seat, said seat having a top surface and a rear, and accommodating a driver and a rear-facing rider, straddling the seat with their legs; and (d) a brace assembly secured to said personal watercraft, said brace assembly including engagement structure for gripping by the rear-facing rider thereby to stabilize the rear-facing rider during operation of said personal watercraft, said engagement structure being movable from a lowered position to a raised position which is above said seat by pulling upwardly on said engagement structure, thereby automatically releasing said engagement structure from the lowered position.

36. A personal watercraft as in claim 35 wherein the height of said engagement structure in the raised position is from about 5 inches to about 12 inches above the height of the top surface of said seat.

37. A personal watercraft as in claim 35, said brace assembly including a support housing cooperatively mounted by a mounting bracket, in common with a tow eye, to said personal watercraft.

38. A personal watercraft as in claim 35, said personal watercraft having an upstanding central body portion supporting said seat, and a boarding handle mounted adjacent the rear of said seat, said brace assembly extending upwardly through an opening defined between said boarding handle and said central body portion.

39. A personal watercraft as in claim 35, said watercraft seat being sized and configured to accommodate at least 3 persons.

40. A personal watercraft as in claim 35, said brace assembly being mounted at an angle to the vertical such that said engagement structure extends over the top surface of said seat.

41. A method of stabilizing a rear-facing rider on a personal watercraft having a front and a rear, and wherein a driver and the rear-facing rider straddle a longitudinally-extending seat, the seat having a top surface, the method comprising providing a brace assembly propinquant the rear of the seat, the brace assembly comprising a generally horizontally-extending hand grip corresponding to a size of up to about 1.5 inches diameter and accessible to be gripped from a front side thereof, the rear-facing rider gripping the hand grip from the front side thereof substantially above the top surface of the seat, thereby stabilizing the rear-facing rider during normal operation of the personal watercraft.

42. A method as in claim 41, including providing apparatus for retracting the hand grip to a height no more than 2 inches above the top surface of the seat, and retracting the hand grip to a height no more than 2 inches above the top surface of the seat, thereby facilitating a person boarding the personal watercraft from the rear and up over the hand grip while maintaining a low profile generally consistent with the height while sitting on seat.

43. A brace assembly for mounting on a personal watercraft at or adjacent the rear of the personal watercraft, and for use by a rear-facing rider on the personal watercraft wherein the personal watercraft includes a longitudinally-extending seat having a rear and being arranged such that a driver and the rear-facing passenger straddle the seat with their legs, said brace assembly including:

(a) engagement structure suitable for engaging primary weight of the rear-facing rider;

(b) a support member supporting said engagement structure; and (c) securing apparatus operative to secure said support member to the personal watercraft at at least two spaced locations adjacent the rear of the seat without creating any invasion of any structure of the personal watercraft.

44. A brace assembly as in claim 43, said brace assembly comprising a hook-bolt for securing said brace assembly to a structural member of the personal watercraft.

45. A brace assembly as in claim 43, said brace assembly comprising a mounting bracket for mounting said brace assembly to the tow eye.

46. A brace assembly as in claim 43, said securing apparatus including upper and lower fastening members, each effective to secure said support member to the personal watercraft without any invasion of any of the hull, including the flotation body of the personal watercraft.

47. A brace assembly for mounting on a personal watercraft at or adjacent the rear of the personal watercraft, and for use by a rear-facing rider on the personal watercraft, said brace assembly comprising:

(a) engagement structure suitable for engaging primary weight of the rear-facing rider;

(b) a support column and a support housing in combination supporting said engagement structure; and (c) height adjustment apparatus effective to control raising and lowering the height of said engagement structure between a raised position and a lowered position, thereby enabling the rear-facing rider to engage the engagement structure substantially above the seat, said height adjustment apparatus being effective to prevent automatic release of said engagement structure for lowering from the raised position.

48. A brace assembly as in claim 47, said height adjustment apparatus being effective to automatically release said engagement structure for raising from the lowered position.

49. A personal watercraft having a front and a rear, said personal watercraft comprising:

(a) a hull, including a floatation body;

(b) drive and control apparatus;

(c) a longitudinally-extending seat, said seat having a rear;

(d) a boarding handle extending rearwardly from said seat; and (e) a brace assembly extending upwardly through an opening defined between said boarding handle and said seat.

50. A personal watercraft as in claim 49, said longitudinally-extending seat having a top surface, said brace assembly comprising engagement structure, and height adjustment apparatus effective to control raising and lowering the height of said engagement structure between a first raised position and a second lowered position no more than 2 inches above the top surface of the seat, thereby enabling a rear-facing rider to engage said engagement structure substantially above the seat.

51. A personal watercraft as in claim 50, said brace assembly comprising a support column received in a support housing, said height adjustment apparatus comprising a first upper aperture in said support column and a second lower aperture in said support column, spaced from said first upper aperture, said first upper aperture comprising a downwardly-extending ramp effecting automatic release, from said upper aperture, of a lock pin disposed therein, when said engagement structure is pulled upwardly by a user thereof.

52. A personal watercraft as in claim 50 wherein the height of said engagement structure in the raised position is from about 5 inches to about 12 inches above the height of the top surface of the seat.

53. A personal watercraft as in claim 49, including a mounting assembly comprising a hook-bolt extending about said boarding handle and thereby mounting said brace assembly to said boarding handle without invading said boarding handle.

54. A personal watercraft as in claim 50, said engagement structure comprising a grip element sized and configured such that hands of an average size adult can readily grip said grip element, and such that said grip element is substantially horizontal.

55. A personal watercraft as in claim 53, said brace assembly comprising a lower fastening member below said hook-bolt, effective to secure said brace assembly to said personal watercraft without any invasion of said hull.

56. A personal watercraft as in claim 49, said brace assembly comprising securing apparatus including upper and lower fastening members effective to secure vertically spaced locations on said brace assembly to said personal watercraft.

57. A personal watercraft, having a bow and a stern, and comprising:

(a) a hull comprising a floatation body;

(b) drive and control apparatus;

(c) a longitudinally-extending seat having a rear portion adjacent the stern, and (d) a brace assembly comprising (i) apparatus for stabilizing a rear-facing rider during movement of the watercraft, and (ii) first and second securing apparatus securing said stabilizing apparatus to the personal watercraft at corresponding upper and lower spaced mounting locations adjacent the rear of the seat, said second securing apparatus comprising a mounting bracket mounting said brace assembly to said watercraft and said first securing apparatus comprising a strap attaching said brace assembly to said watercraft at said first upper mounting location, said personal watercraft further comprising a tow eye mounted to the stern of the personal watercraft, through said mounting bracket.

58. A personal watercraft, having a bow and a stern, and comprising:

(a) a hull comprising a floatation body, (b) drive and control apparatus;

(c) a longitudinally-extending seat having a rear portion adjacent the stern, and (d) a brace assembly comprising (i) apparatus for stabilizing a rear-facing rider during movement of the watercraft, and (ii) first and second securing apparatus securing said stabilizing apparatus to the personal watercraft at corresponding upper and lower spaced mounting locations adjacent the rear of the seat, said upper mounting location being defined at a boarding handle mounted on the stern of the personal watercraft, said apparatus mounting said support housing comprising a hook bolt connecting said support housing to said boarding handle when said support housing is positioned adjacent said boarding handle.

59. A personal watercraft, having a bow and a stern, and comprising:

(a) a hull comprising a floatation body;

(b) drive and control apparatus;

(c) a longitudinally-extending seat having a rear portion adjacent the stern, and (d) a brace assembly comprising (i) apparatus for stabilizing a rear-facing rider during movement of the watercraft, and (ii) first and second securing apparatus securing said stabilizing apparatus to the personal watercraft at corresponding upper and lower spaced mounting locations adjacent the rear of the seat, said second securing apparatus comprising a mounting bracket mounting said support housing to said watercraft and said first securing apparatus comprising a strap attaching said support housing to said watercraft at said first upper mounting location, said upper mounting location being defined at a boarding handle mounted on the stern of the personal watercraft, said strap mounting said brace assembly against the boarding handle.

60. A personal watercraft comprising:

(a) a floatation body including a hull having a front and a stern;

(b) a longitudinally-extending seat having a rear portion adjacent the stern of the hull;

(c) a watercraft structural member pre-mounted to the hull below the seat;

(d) a boarding handle having a grasping element extending rearwardly of said hull adjacent said rear portion of said seat and at least in part defining an opening disposed rearwardly of the seat; and (e) a brace assembly mounted to the watercraft structural member below said boarding handle and extending upwardly through the opening.

61. A personal watercraft as in claim 60, said brace assembly further comprising securing apparatus securing said brace assembly to said personal watercraft at vertically spaced locations on said brace assembly, said securing apparatus including upper and lower securing members.

62. A personal watercraft as in claim 60, said brace assembly further comprising an engagement structure nd a height adjustment apparatus for raising and lowering said engagement structure between at least a first raised position and a second lowered position, at least the first position being above the height of the top surface of said longitudinally extending seat, thereby enabling a rear-facing rider to grip said engagement structure above the height of the seat.

63. A personal watercraft as in claim 62, said brace assembly further comprising a support column received in a support housing and slidable within said support housing during normal use, said height adjustment apparatus comprising a first upper aperture in one of said support housing and said support column and spaced from a second lower aperture in the respective one of said support housing and said support columns and a pin operably disposed in the other of said support housing and said support column for indexing with the first and second apertures, when said pin is operated and said support column is slid relative to said support housing.

64. A personal watercraft as in claim 63 wherein the height of said engagement structure in the first raised position is from about 5 inches to about 12 inches above the height of the top of the seat.

65. A personal watercraft as in claim 64, said engagement structure comprising a grip element that is substantially horizontal and sized and configured such that average size adult hands can encircle greater than half a perimeter of the hand grip.

* * * * *